United States Patent [19]

Takahashi et al.

[11] 4,179,971

[45] Dec. 25, 1979

[54] PITCH BEND APPARATUS FOR ELECTRONIC MUSICAL INSTRUMENT

[75] Inventors: Toshiyuki Takahashi; Masahiko Koike; Haruyuki Suzuki, all of Hamamatsu, Japan

[73] Assignee: Nippon Gakki Seizo Kabushiki Kaisha, Hamamatsu, Japan

[21] Appl. No.: 944,293

[22] Filed: Sep. 21, 1978

[30] Foreign Application Priority Data

Sep. 24, 1977 [JP] Japan ..... 52-114914
Sep. 24, 1977 [JP] Japan ..... 52-128623

[51] Int. Cl.[2] ..... G10H 1/02

[52] U.S. Cl. ..... 84/1.24; 84/1.01; 84/DIG. 18

[58] Field of Search ..... 84/1.01, 1.24, 1.26, 84/DIG. 18, 445, 446, 447, DIG. 8

[56] References Cited

U.S. PATENT DOCUMENTS

| | | | |
|---|---|---|---|
| 3,859,884 | 1/1975 | Grable | 84/1.01 |
| 3,991,645 | 11/1976 | Luce | 84/DIG. 8 |
| 4,085,647 | 4/1978 | Adachi | 84/1.26 |

*Primary Examiner*—B. Dobeck
*Assistant Examiner*—Forester W. Isen
*Attorney, Agent, or Firm*—Koda and Androlia

[57] ABSTRACT

A pitch bend apparatus for electronic musical instrument having a voltage-controlled oscillator that works as a tone generator is provided with a first variable resistor for operating the pitch bend as well as a second variable resistor for setting a varying width of pitch bend or a maximum amount of pitch deviation. The varying width of the pitch bend is controlled by connecting the first and second variable resistors into an amplifier circuit to control the gain thereof, or by controlling the voltage applied to the first variable resistor by means of the second variable resistor.

4 Claims, 5 Drawing Figures

PITCH BEND APPARATUS FOR ELECTRONIC MUSICAL INSTRUMENT

BACKGROUND OF THE INVENTION

1. Field of the Invention

The present invention is related to an electronic musical instrument having a voltage-controlled oscillator that works as a tone generator, and more specifically to an improved pitch bend apparatus provided with a variable resistor for operating the pitch bend as well as another variable resistor for variably setting the varying width of the pitch bend.

2. Prior Art

Electronic musical instruments such as music synthesizers are, usually, so constructed as to synthesize a musical tone signal of a pitch corresponding to a depressed key by controlling a voltage-controlled oscillator as a tone generator with a pitch voltage which is differently determined for each of the keys. The electronic musical instruments of this sort have so far been equipped with a pitch bend apparatus which allows the pitch to be increased or decreased when a pitch bend operator (usually, a slider of a variable resistor) is moved toward the plus side or the minus side with a key being maintained depressed.

However, with the conventional pitch bend apparatus having a pitch bend operator only as an operating means, it was not allowed to control the varying width of the pitch bend from the external side. That is, the maximum amount of pitch deviation in the upper and lower directions had been fixed to, for example, ±1200 cents (equivalent to one octave). With such a pitch bend apparatus, therefore, when it was intended to deviate the pitch by, for example, ±500 cents during the play, the pitch bend operator must be so operated that it was stopped at suitable position within the variable range. In practice, however, such an operation was very difficult making it impossible to repeat the play with accurate reproduceability.

SUMMARY OF THE INVENTION

The object of the present invention is to provide an improved pitch bend apparatus which is capable of suitably controlling the varying width of the pitch bend (maximum amount of pitch deviation).

According to a preferred embodiment of the present invention, there are provided a first variable resistor for varying the pitch bend by controlling the gain of a gain-variable amplifier circuit, as well as a second variable resistor for controlling the varying width of the gain thereby to control the varying width of the pitch bend.

According to another preferred embodiment of the present invention, there are provided a first variable resistor for operating the pitch bend, as well as a second variable resistor for controlling the voltage applied to the first variable resistor, thereby to control the varying width of the pitch bend.

One of the advantages of the pitch bend apparatus of the present invention is that the varying width of the pitch bend can be controlled over a wide range and stably by means of a simply constructed circuit.

BRIEF DESCRIPTION OF THE DRAWINGS

These and other objects, features and advantages of the present invention will become more apparent from the following description of preferred embodiments thereof illustrated in conjunctin with the accompanying drawings in which.

DETAILED DESCRIPTION OF THE INVENTION

Figure 1:
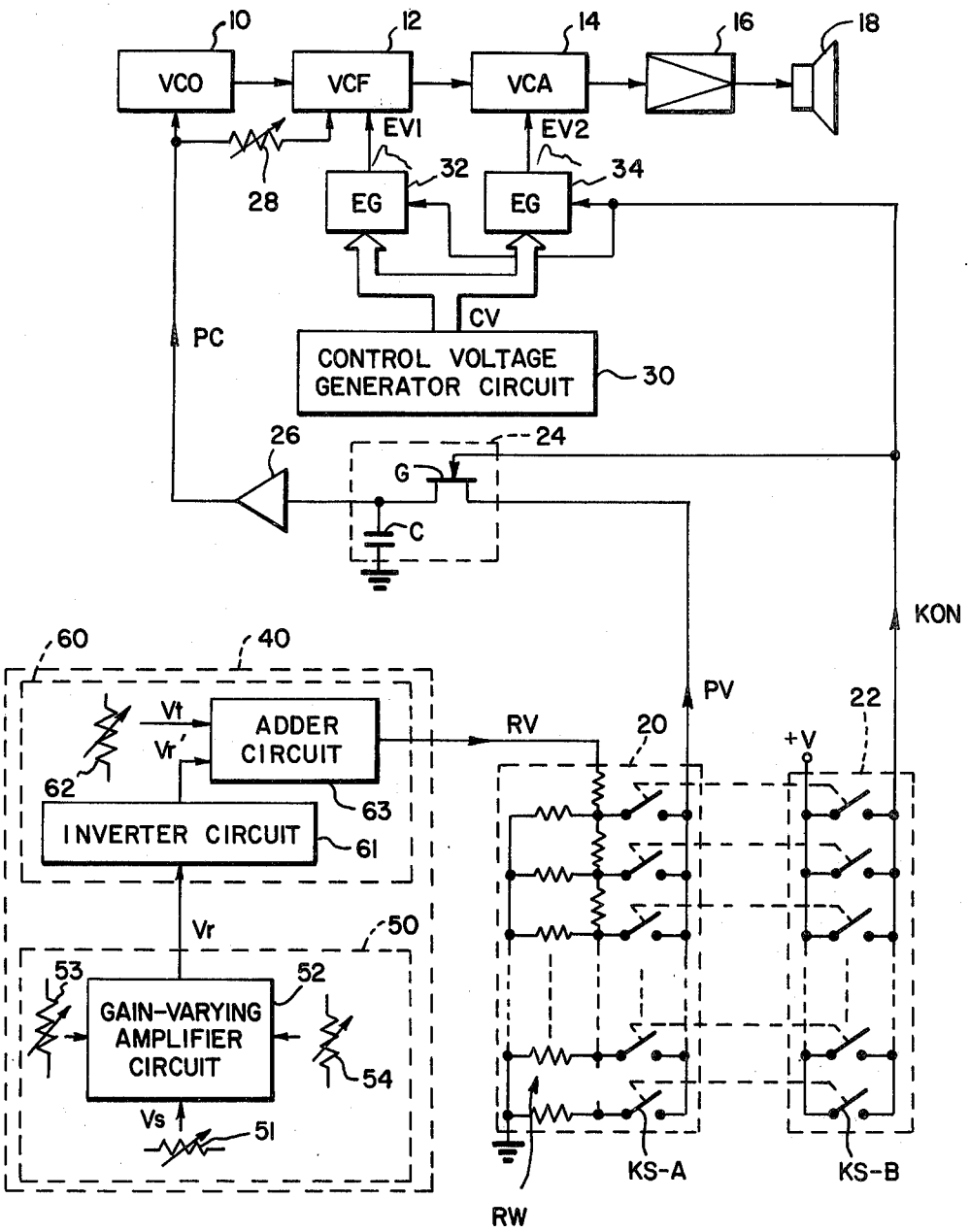
FIG. 1 is a block diagram of an electronic musical instrument equipped with a pitch bend apparatus according to an embodiment of the present invention.

FIG. 1 shows an electronic musical instrument equipped with a pitch bend apparatus according to an embodiment of the present invention, in which reference numeral 10 represents a voltage-controlled oscillator (VCO) that works as a tone generator of which oscillating frequency will be controlled by a pitch control signal PC. The pitch control signal PC is so generated as to acquire a voltage corresponding to a note name of a depressed key as will be mentioned later, and a sound-source signal of a pitch (frequency) corresponding to the note name of the depressed key is produced on the output side of the VCO 10. The sound-source signal is sent to a voltage-controlled amplifier (VCA) 14 via a voltage-controlled filter (VCF) 12; tone characteristics are imparted to the sound-source signal by the VCF 12 and amplitude envelope characteristics are imparted to said sound-source signal by the VCA 14. A musical tone signal produced on the output terminal of the VCA 14 is fed to a speaker 18 via an output amplifier 16 where it is converted into a musical tone.

Below is illustrated a system for generating pitch control signals PC. This system includes a pitch voltage generator circuit 20, a key-on signal generator circuit 22, a sample holding cirucit 24, and a buffer 26. The pitch voltage generator circuit 20 produces a pitch voltage PV corresponding to the note name of each key based on a reference pitch voltage RV fed from a reference pitch voltage generator circuit 40 that will be mentioned later, and consists of a series of key switches KS-A and a resistor circuit network RS for feeding voltage of various levels to said key switches. The key-on signal generator circuit 22 has a series of key switches KS-B interlocked to the key switches KS-A. A voltage +V is commonly applied to the terminal on one side of the key switches KS-B, and the terminals on the other side of the key switches KS-B are commonly connected together so that a key-on signal KON is produced from the commonly connected point. The key-on signal KON indicates that any one of the keys is turned on. If a given key is depressed, the pitch voltage generator circuit 20 produces a pitch voltage PV corresponding to the note name of the depressed key, and the key-on signal generator circuit 22 produces a key-on signal KON which indicates that a key is turned on. The pitch voltage PV is fed to the sample holding circuit 24 together with the key-on signal KON. The sample holding circuit 24 indicates a sampling gate G for sampling the pitch voltage PV responsive to the key-on signal KON, and a capacitor C for holding the output of the gate G. After sampled and held responsive to the key-on signal KON, the pitch voltage PV is fed to the buffer 26, so that a pitch control signal PC is produced on the output side of the buffer 26. The pitch control signal PC has a voltage corresponding to the note name of the depressed key. Therefore, if the VCO 10 is controlled by means of the pitch control signal, it is possible to produce a sound-source signal of a frequency corresponding to the note name of the depressed key. The pitch control signal PC is also supplied to the VCF 12 via a variable resistor 28, so that the cut-off frequency of the VCF 12 is controlled responsive to the change of the pitch. The VCF 12 is ususally so controlled that the cut-off frequency is increased with the increase of the pitch.

A control voltage generator circuit 30, on the other hand, generates control voltages CV of several levels required for forming envelope signals corresponding to patterns of the change of tone (filtering characteristics) and the change of amplitude (gain of amplification) when a key is depressed. The control voltages CV are fed to envelope generator 32 and 34. The key-on signal KON is also supplied to the envelope generators 32 and 34. As the key-on signal KON is produced, the envelope generator 32 produces an envelope signal EV1 corresponding to a pattern of the change of tone (filtering characteristics) when a key is depressed and controls the VCF 12 to vary the filtering characteristics with the lapse of time, while the envelope generator 34 produces an envelope signal EV2 corresponding to a pattern of the change of amplitude when a key is depressed and controls the VCA 14 thereby to vary its amplification gain. Owing to the abovementioned construction, there are obtained on the output side of the VCA 14 a musical tone signal having a frequency (pitch) corresponding to the note name of the depressed key, predetermined tone characteristics and amplitude envelope characteristics, whereby the musical tone signal is fed via the output amplifier 16 to the speaker 18 where it is converted into a musical tone.

According to the teaching of the invention, the reference pitch voltage RV which is a base of the pitch voltage PV of the pitch voltage PV generator circuit 20 is varied according to a particular mode, thereby to operate the pitch bend, i.e., to increase and decrease the pitch over a predetermined width. That is, a circuit 40 for generating the reference pitch voltage RV is equipped with a pitch bend device 50 and a gain-varying amplifier circuit 52 to which will be applied through its input terminal a reference voltage Vs from a variable resistor 51 for setting a reference voltage. The gain of the amplifier circuit 52 is controlled by a variable resistor 53 for operating the pitch bend, and the varying width of the gain is controlled by a variable resistor 54 for controlling the varying width of the pitch bend. As a result, the amplifier circuit 52 produces on the output side an output voltage Vr corresponding to the reference voltage Vs which is multiplied by a gain determined by variable resistors 53 and 54.

The tuning circuit 60 has an inverter circuit 61 for inverting the polarity of the amplified output Vr, and an adder circuit 63 which receives through its one input terminal an output Vr′ of the inverter circuit 61 and which further receives through its other input terminal a tuning voltage Vt fed from a variable resistor 62 for effecting the tuning. The adder circuit 63 produces on its output side a reference pitch voltage RV.

Figure 2:
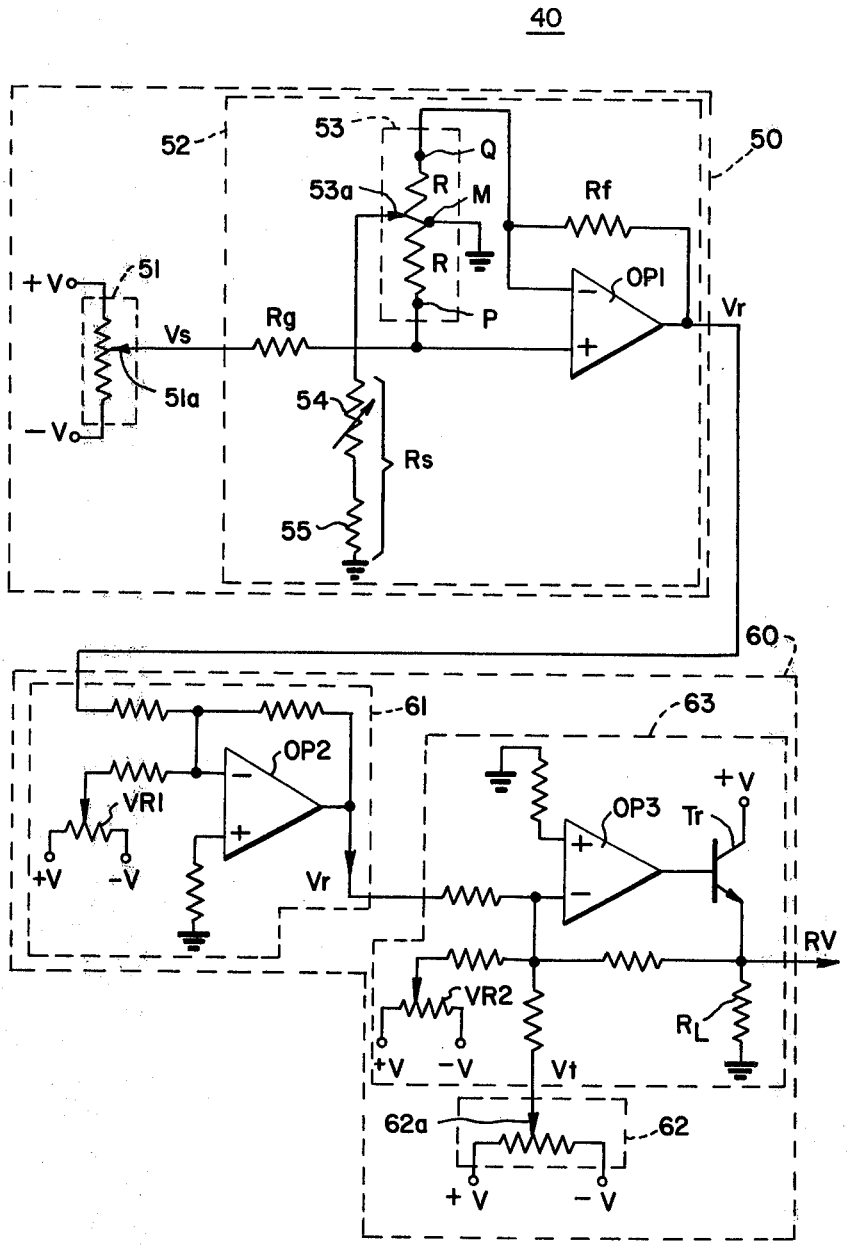
FIG. 2 is a circuit diagram showing in detail a reference pitch voltage generator circuit used by the electronic musical instrument of FIG. 1.

Below is illustrated in detail the internal setup of the reference pitch voltage generator circuit 40 with reference to FIG. 2. In FIG. 2, the same portions as those of FIG. 1 are denoted by the same symbols. Referring, first, to the pitch bend device 50, the gain-amplifier (hereinafter referred to as "ope amp") OP1 which is so connected as to operate as a noninverting amplifier. To a noninverting input terminal of the ope amp OP1 is supplied the reference voltage Vs from a slider 51*a* of a variable resistor 51 via a series resistor Rg. To both terminals of the variable resistor 51 are applied voltages +V and −V. By operating the slider 51*a*, a reference voltage Vs can be so set as to serve as a reference of the reference pitch voltage RV on which will be based the pitch voltage. To the noninverting input terminal and the inverting input terminal of the ope amp OP1 are connected one terminal P and other terminal Q of a variable resistor 53, respectively, and a neutral point M of the resistor 53 is grounded. Between a slider 53*a* which is a pitch bend operator of the variable resistor 53 and the ground are connected a variable resistor 54 and a resistor 55 in series, and the resultant series resistance of the resistors 54 and 55 is denoted by Rs. Even when the slider 53*a* of the variable resistor 53 comes into contact with one end P, and further even when the resistance of the variable resistor 54 is set at zero, the resistor 55 which is inserted between the noninverting input terminal of the ope amp OP1 as a noninverting amplifier. Further, a feedback resistor Rf having a resistance nearly equal to that of the series resistor Rg is connected between the noninverting input terminal and the output terminal of the ope amp OP1.

With the thus constructed pitch bend device 50, the variable resistor 54 is adjusted beforehand, and the slider 53*a* of the movable resistor 53 is reciprocally displaced to a maximum degree between the terminal P and the terminal Q, whereby the amplified output voltage Vr which equally varies toward the higher and lower sides with the level of the reference voltage Vs as a center, can be produced on the output side of the ope amp OP1.

A suitable example of the invention is mentioned below by way of numerical figures, and the operation of the circuit is illustrated below in detail. If now the resistance R between the neutral point M of the variable resistor 53 and the terminal P, and the resistance between the neutral point M of the variable resistor 53 and the terminal Q are each supposed to be about 25 kiloohms, and the series resistance Rg which is equal to the feedback resistance Rf is about 2.7 kiloohms, the output voltages Vr of the ope amp OP1 can be mathematically expressed as follows depending upon (A) when the slider 53*a* is located at the neutral point M, (B) when the slider 53*a* is located at a position corresponding to the terminal P, and (C) when the slider 53*a* is located at a position corresponding to the other terminal Q.

In the first case (A), the output voltage $Vr_1$ will be given by $$Vr_1 = \frac{R}{Rg + R} \cdot (1 + \frac{Rf}{R}) \cdot Vs \quad (1)$$

Here, since Rf=Rg, the equation (1) will become $$Vr_1 = Vs \quad (2)$$

In the second case (B), the output voltage $Vr_2$ will be given by $$Vr_2 = \frac{Rs//R}{Rg + Rs//R} \cdot (1 + \frac{Rf}{R}) \cdot Vs \quad (3)$$

Here, if $$(\frac{Rs//R}{Rg + Rs//R}) \cdot (1 + \frac{Rf}{R}) = K$$

then, the equation (3) will be expressed as $$Vr_2 = K \cdot Vs \quad (4)$$

In the third case (C), the output voltage $Vr_3$ is given by $$Vr_3 = \frac{R}{Rg + R} \cdot (1 + \frac{Rf}{Rs//R}) \cdot Vs \quad (5)$$

Here, since Rf=Rg, the above equation can be modified as $$(\frac{R}{Rg + R}) \cdot (1 + \frac{Rf}{Rs//R}) = (\frac{R}{Rg + R}) \cdot \frac{Rs//R + Rf}{Rs//R} = \frac{1}{K}$$

so that the equation (5) is expressed as $$Vr_3 = 1/K \cdot Vs \quad (6)$$

For example, if $K = \frac{1}{2}$ and Vs=2 volts, according to the above equations (2), (4) and (6), the voltages $Vr_1$ and $Vr_2$ and $Vr_3$ will be $Vr_1 = 2$ volts, $Vr_2 = 4$ volts and $Vr_3 = 1$ volt. The deviation of pitch when such voltages are used as a reference pitch voltage RV will be ±1200 cents (equivalent to 1 octave).

When expressed in terms of cents, the deviation of pitch PD will usually be defined as follows:

$$PD = 1200 \log_2 f/f_o \quad (7)$$

where $f_o$ represents a reference frequency, and f a frequency of a virtually produced sound. With the electronic musical instrument illustrated by way of the abovementioned embodiment, there is a proportional relation between the frequency and the voltage for controlling the frequency. Therefore, in equation (7), the frequencies f and $f_o$ can be substituted by the corresponding voltages. If the voltage $Vr_1$ is used as a reference, and if voltages $Vr_2$ and $Vr_3$ are used to deviate the pitch, the deviation of pitch expressed in terms of cents will be in the case of (B), $$PD_B = 1200 \log_2 \frac{Vr_2}{Vr_1} = 1200 \log_2 K \quad (8)$$

and in the case of (C), $$PD_C = 1200 \log_2 \frac{Vr_3}{Vr_1} = -1200 \log_2 K \quad (9)$$

Comparison of equation (8) with equation (9) indicates that the pitch is deviated toward the higher side and lower side in equal amount. The agreement of pitch deviation in the upper and lower sides is the greatest feature of the pitch bend apparatus according to this embodiment, because the slider 53*a* which is a pitch bend operator is usually displaced in both directions to a maximum degree with the neutral point M as a center. Consequently, if the deviation of pitch in the upper and lower sides is not in agreement, there will be introduced unnatural and strained variation in the musical tone depending upon the amount of inconformity.

The output voltage Vr from the ope amp OP1 can directly be used as the reference pitch voltage RV. In this embodiment, however, for the purpose that the tuning can be attained, the output voltage Vr is supplied to a tuning adder circuit 63 via an inverting circuit 61 as shown in FIG. 2. The inverting circuit 61 is so connected that the ope amp OP2 works as an inverting amplifier. To the inverting input side of the ope amp OP2 are fed an output voltage Vr from the ope amp OP1 and a correcting voltage from a variable resistor VR1 in an added manner. The output voltage Vr' of the ope amp OP2 essentially consists of inverting the output voltage Vr of the ope amp OP1, and is fed to the inverting input side of the ope amp OP3. To the inverting input side of the ope amp OP3 are further applied the output voltage Vr' of the ope amp OP2 as well as the correcting voltage of the variable resistor VR2 and a tuning voltage of the variable resistor VR2 and a tuning voltage Vt from a slider 62*a* of a tuning operator 62. The output terminal of the ope amp OP3 that works as an inverting amplifier is connected to the base of an emitter-follower transistor Tr, so that the reference pitch voltage RV is taken out from a load resistor $R_L$ connected to the emitter of the transistor Tr. The reference pitch voltage RV is obtained in the form of the output voltage Vr of the ope amp OP1 on which is superposed the tuning voltage Vt, and is varied responsive to the change of resistance of the variable resistor 53 for operating the pitch bend and responsive to the change of resistance of the variable resistor 54 for controlling the varying width of the pitch bend.

Figure 3:
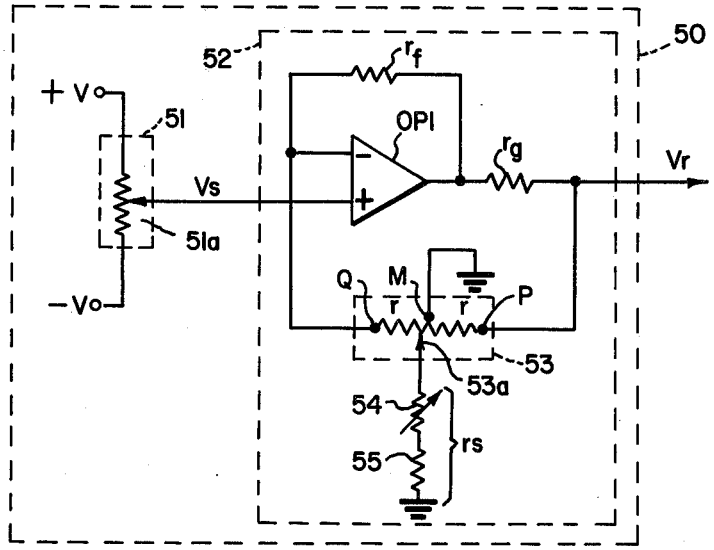
FIG. 3 is a circuit diagram showing a pitch bend apparatus according to another embodiment of the present invention.

FIG. 3 shows a further embodiment of a pitch bend device having the same function as the pitch bend device 50 shown in FIG. 2, in which the same portions as those of FIG. 2 are represented by the same symbols. First, the pitch bend device 50 is provided with the ope amp OP1 which is so connected that the gain-varying amplifier circuit 52 works as a noninverting amp, and the reference voltage Vs is directly supplied from the slider 51*a* of the variable resistor 51 to the noninverting input terminal of the ope amp OP1. The inverting input of the ope amp OP1, on the other hand, is connected to the output terminal of the ope amp OP1 via the variable resistor 53 and the output resistor rg, and the neutral point M of the variable resistor 53 is grounded. The variable resistor 54 and the resistor 55 are connected in series between the slider 53*a* that serves as a pitch bend operator of the variable resistor 53 and the grounded point. The resultant series resistance is denoted by rs. The feedback resistor rf having a resistance nearly equal to that of the output resistor rg is connected between the inverting input terminal of the ope amp OP1 and the output terminal thereof, and the output voltage Vr of the gain-varying amplifier circuit 52 is taken out from a connecting point of the output resistor rg and the variable resistor 53.

The variable resistor 54 and the variable resistor 53 of the thus constructed pitch bend device 50 can be adjusted quite in the same manner as that of the variable resistor 54 and the variable resistor 53 of FIG. 2. Like the above case mentioned with reference to FIG. 2, when the slider 53a is set at the middle point M, at one terminal P and at the other terminal Q, the output voltages Vr which correspond to the above-mentioned examples can be mathematically expressed as follows:

In the case of (A), the output voltage $Vr_{11}$ can be given by $$Vr_{11} = \frac{r}{r+rg} \cdot (1 + \frac{rf}{r}) \cdot Vs \quad (10)$$

Here, if the condition rf=rg is taken into consideration, the above equation (10) can be expressed as $$Vr_{11} = Vs \quad (11)$$

In the case of (B), the output voltage $Vr_{12}$ is given by $$Vr_{12} = \frac{rs//r}{rg + rs//r} \cdot (1 + \frac{rf}{r}) \cdot Vs \quad (12)$$

Here, if $$\frac{rs//r}{rg + rs//r} \cdot (1 + \frac{rf}{r}) = K$$

then, the above equation (12) will be $$Vr_{12} = k \cdot Vs \quad (13)$$

In the case of (C), the output voltage $Vr_{13}$ is given by $$Vr_{13} = \frac{r}{r+rg} \cdot (1 + \frac{rf}{rs//r})]Vs \quad (14)$$

Here, if the condition rf=rg is taken into consideration to effect the modification as $$\frac{r}{r+rg} \cdot (1 + \frac{rf}{rs//r}) = \frac{r}{r+rg} \cdot \frac{rs//r + rf}{rs//r} = \frac{1}{k}$$

then, the above equation (14) will be expressed as $$Vr_{13} = 1/K \cdot Vs \quad (15)$$

The equations (11), (13) and (15) of the abovementioned cases (A), (B) and (C) are quite the same as the equations (2), (4) and (6) mentioned earlier, indicating that the pitch bend device 50 of FIG. 3 has the same function as the pitch bend device 50 of FIG. 2. Below is illustrated a reference pitch voltage generator circuit having a pitch bend device according to still another embodiment of the present invention, with reference to FIG. 4.

A circuit 70 for generating the reference pitch voltage RV is equipped with a pitch bend device 80 and a tuning circuit 90. The pitch bend device 80 consists of a variable resistor 81 for controlling the varying width of the pitch bend, a voltage distributor circuit 82, a variable resistor 83 for operating the pitch bend, a variable resistor 84 for setting the reference voltage, and an adder circuit 85. The variable resistor 81 for controlling the varying width of the pitch bend supplies a control voltage Va to the voltage distributor circuit 82 which supplies a voltage $V_1$ corresponding to a control voltage Va of one polarity to one terminal P of the variable resistor 83 for operating the pitch bend and which further supplies a voltage $-V_2$ corresponding to the control voltage Va of the opposite polarity to the other terminal Q of the variable resistor 83. The neutral point M of the variable resistor 83 for oprating the pitch bend is grounded, and a pitch bend voltage Vb is taken out from a slider 83a that serves as a pitch bend operator. To one adder input terminal of the adder circuit 85 is applied a pitch bend voltage Vb, and to the other adder input terminal is applied a predetermined reference voltage Vs from the variable resistor 84 for setting the reference voltage. The added output Vr taken out from the output side of the adder circuit 85 consists of the reference voltage Vb. If now the slider 83a that serves as a pitch bend operator is reciprocally moved from a position corresponding to the neutral point M toward one end P and other end Q, a pitch bend voltage Vb of either the positive polarity or the negative polarity corresponding to the displacement of the slider 83a is added to the reference voltage Vs, so that the added output voltage Vr undergoes variation toward the upper and lower directions by a quantity equivalent to the added value with the level of the reference voltage Vs as a center. In this case, since the voltages $V_1$ and $-V_2$ supplied to the variable resistor 83 can be changed depending upon the control voltage Va, the varying width of the pitch bend voltage Vb can be arbitrarily set by means of the variable resistor 81.

With reference to a tuning circuit 90, on the other hand, a tuning voltage Vt supplied from the variable resistor 91 for attaining the tuning and a voltage Vr supplied from the adder circuit 85 are added together by means of an adder circuit 92, and the reference pitch voltage RV composed of the added output voltage of the adder circuit 92 is supplied to the same pitch voltage geneartor circuit as that denoted by reference numeral 20 in FIG. 1. Therefore, the reference pitch voltage RV consists of the added output voltage Vr to which is added, or from which is subtracted, the tuning voltage Vt, and can be suitable changed by operating the variable resistor 91 for the purpose of attaining the tuning.

Figure 4:
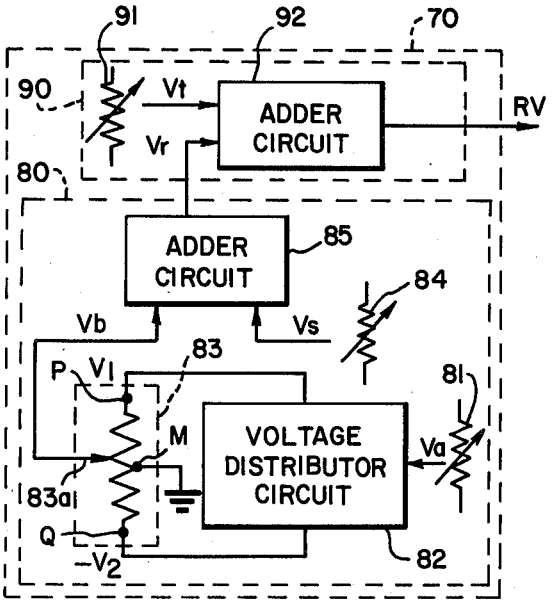
FIG. 4 is a block diagram of a reference pitch voltage generator circuit having a pitch bend apparatus according to a further embodiment of the present invention.
Figure 5:
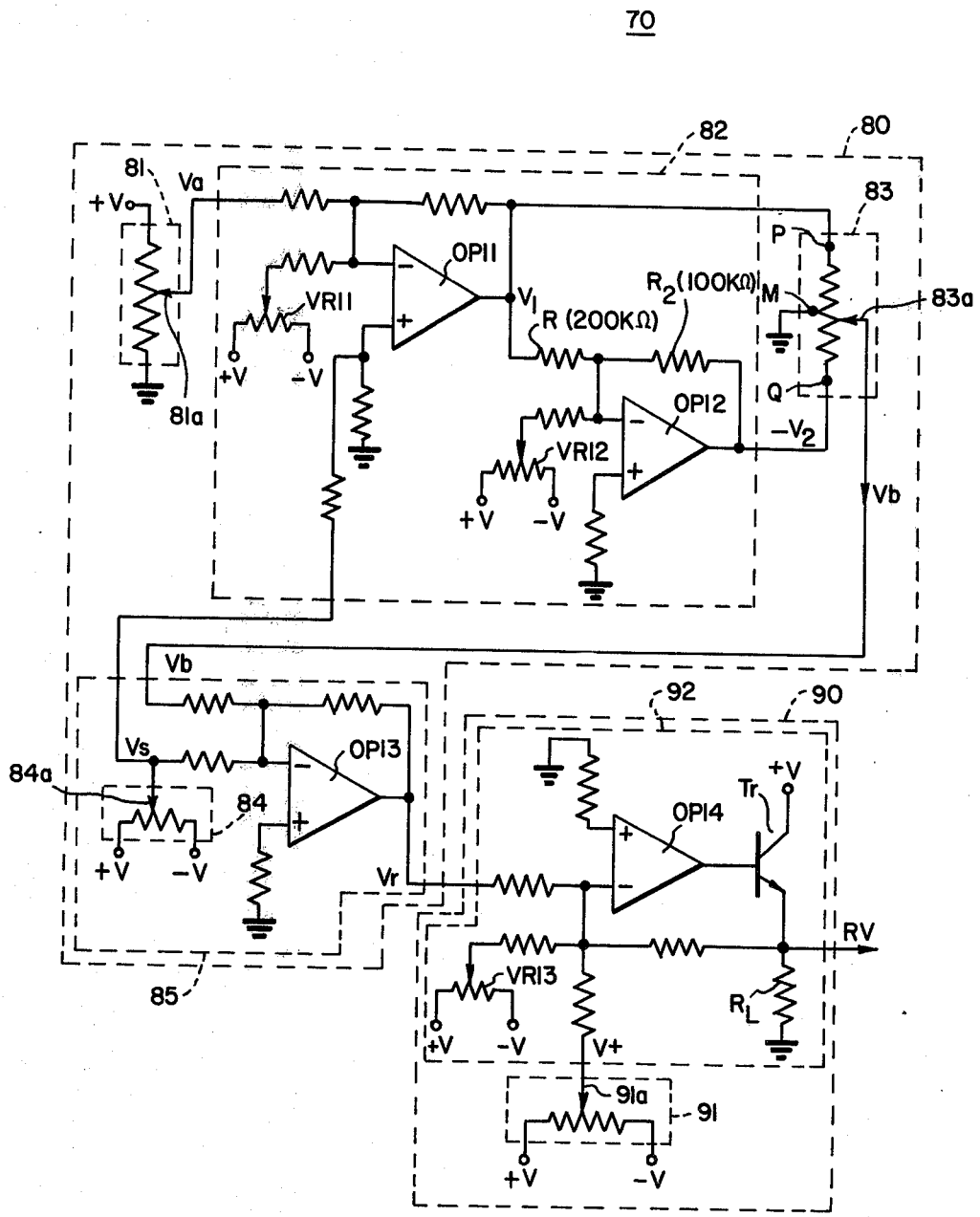
FIG. 5 is a circuit diagram showing in detail the reference pitch voltage generator circuit of FIG. 4.

FIG. 5 shows in detail an example of the setup of the reference pitch voltage generator circuit 70 shown in FIG. 4, in which the same portions as those of FIG. 4 are denoted by the same symbols. In a pitch bend device 80, a voltage +V is applied to one end of a variable resistor 81 for controlling the varying width of the pitch bend, and the other end of said variable resistor 81 is grounded. A voltage Va taken out from a slider 81a of the variable resistor 81 is supplied to the inverting input side of the ope amp OP11 which is so connected as to work as a differential amplifier. A correcting voltage from a variable resistor VR11 is applied to the inverting input side of the ope amp OP11 in such a manner that it is superposed on the voltage Va. The reference voltage Vs is also applied to the noninverting input terminal of the ope amp OP11 from a variable resistor 84 of the adder circuit 85. The output voltage $V_1$ taken out from the ope amp OP11, in one hand, is applied to one end P of a variable resistor 83 for operating the pitch bend, and, on the other hand, is applied to the inverting input side of an ope amp OP12 which is so connected as to work as an inverting amplifier. To the inverting input side of the ope amp OP12 is applied a correcting voltage from the variable resistor VR12 in such a manner that it is superposed on said output voltage $V_1$. An input resistor $R_1$ connected to the inverting input terminal of the ope amp OP12 and a feedback resistor $R_2$ connected between the inverting input terminal and the output terminal, will have resistances of, for example 200 kiloohms and 100 kiloohms, respectively. Therefore, the output voltage $-V_2$ of the ope amp OP12 applied to the other end Q of the variable resistor 82 is equal to one-half of the voltage $V_1$. Thus, the voltage distributor circuit 82 including ope amps OP11 and OP12 supplies a relatively high voltage $V_1$ of one polarity corresponding to the magnitude of the control voltage Va and a relatively low voltage $-V_2$ of opposite polarity to one end P of the variable resistor 83 and to the other end Q of the variable 83, respectively. Here, the voltage $-V_2$ is selected to be of a small value for the purpose that when it is added to the reference voltage Vs, the resulting reference pitch voltage RV will never decrease below zero (with the reference pitch voltage RV being near to zero or below, the VCO 10 of FIG. 1 fails to operate).

A pitch bend voltage Vb taken out from a slider 83*a* of the variable resistor 83 is fed to the adder circuit 85. The adder circuit 85 includes an ope amp OP13 which is so connected as to operate as an inverting amplifier, and to the inverting input side of the ope amp OP13 is applied the pitch bend voltage Vb and the reference voltage Vs in a superposed manner. The reference voltage Vs is taken out from a slider 84*a* of a variable resistor 84 to which both terminals have been applied voltages +V and −V. Being so constructed, the output side of the ope amp OP13 produces a voltage Vr which is an inverted sum of the pitch bend voltage Vb and the reference voltage Vs.

A tuning circuit 90 includes an ope amp OP14 which is so connected as to work as an inverting amplifier. To the inverting input side of the ope amp OP14 are applied an addition output voltage Vr from the adder circuit 85, a correcting voltage from the variable resistor VR13 and a tuning voltage Vt from a slider 91*a* of the variable resistor 91 for attaining the tuning in a superposed manner. The output terminal of the ope amp OP14 is connected to the base of an emitter-follower transistor Tr, and the reference pitch voltage RV composed of a voltage obtained by inverting the sum of the abovesaid three input voltages is taken out from a load resistor RL of the transistor Tr.

According to the circuit arrangement shown in FIG. 5, the pitch bend can be operated by means of the variable resistor 83, the varying width of the pitch bend can be controlled by means of the variable resistor 81, and the tuning can be effected by means of the variable resistor 91, all in the same manner as mentioned with reference to FIG. 4, whereby it is possible to obtain the reference pitch voltage RV depending upon these operations. The variable resistors VR11, VR12, VR13 and 84 are arrayed in the body of a musical instrument, and have been suitably adjusted during the step of manufacturing.

Below is concretely illustrated to which extent the pitch bend (deviation of pitch) can be produced by operating the pitch bend by means of the pitch bend device 80 shown in FIG. 5. First, the pitch deviation PD can be defined by the following relation if expressed in terms of cents:

$$PD = 1200 \log_2 f/f_o \tag{16}$$

where $f_o$ represents a reference frequency, and f a frequency of a virtually produced sound. In an electronic musical instrument of the type illustrated by way of the embodiment of FIG. 1, since there is a proportional relation between the pitch voltage and the frequency of the produced sound, a maximum pitch deviation PDUM toward the higher side and a maximum pitch deviation PDLM toward the lower side can be given by the following equations (17) and (18), respectively:

$$PDUM = 1200 \log_2 \frac{Vs + V_1}{Vs} \tag{17}$$

$$PDUM = 1200 \log_2 \frac{Vs - V_2}{Vs}$$

$$= 1200 \log_2 \frac{Vs - V_1/2}{Vs} \tag{18}$$

here, the reference voltage Vs is set at, for example, 2 volts by means of the variable resistor 84. Hence, if this value is inserted into the above equations (17) and (18), the following equations (19) and (20) will be obtained.

$$PDUM = 1200 \log_2 (1 + V_1/2) \tag{19}$$

$$PDLM = 1200 \log_2 (1 - V_1/4) \tag{20}$$

According to these equations (19) and (20), it is obvious that the pitch deviation is controlled responsive to the voltage $V_1$ (or a control voltage Va for controlling said voltage $V_1$). For example, to deviate the pitch upwardly by 600 cents, the value of the voltage $V_1$ needed is about 0.82 volt from the equation (19); with this voltage, the pitch is deviated toward the lower side by about −402 cents according to equation (20). Therefore, if the variable resistor 81 is so adjusted that the voltage $V_1$ is 0.82 volt, and if the slider 83*a* that works as a pitch bend operator is moved toward the upper and lower directions, i.e., toward the side P and the side Q to a maximum degree, the pitch bend can be operated accompanying the pitch deviation by 600 cents toward the higher side and by −402 cents toward the lower side. When it is desired to change the maximum amount of pitch deviation in the upper and lower directions, i.e., when it is desired to change the varying width of the pitch bend, the variable resistor 81 should be adjusted to set other value as the voltage $V_1$. The greatest merit of the present invention is that various values can be selected in regard to the maximum amount of pitch deviation in the upper and lower directions by such a simple operation.

The following Table shows maximum amounts PDUM of the pitch deviation toward the upper direction in comparison with the maximum amounts PDLM of pitch deviation toward the lower direction corresponding to each of the PDUM values. It will be convenient if whole or part of the maximum amounts of pitch deviation are indicated on the operation panel on which the slider 81*a* of the variable resistor 81 is moved, such that rough indication for controlling the varying width of the pitch bend is presented. In the following Table, units are all by cent.

Table

| | | | | | | | |
|---|---|---|---|---|---|---|---|
| PDUM | 1200 | 1100 | 1000 | 900 | 800 | 700 | |
| PDLM | −1200 | −1015 | −858 | −722 | −602 | −496 | |
| PDUM | 600 | 500 | 400 | 300 | 200 | 100 | 0 |
| PDLM | −402 | −317 | −241 | −172 | −109 | −52.3 | 0 |

As will be understood from the foregoing description, the pitch bend device according to the present invention does not require any cumbersome operation such as controlling the mechanical displacement of the pitch bend operator, and makes it possible to control the varying width of pitch bend maintaining good reproduceability simply by adjusting the variable resistor for controlling the varying width of the pitch bend and displacing the operator of the variable resistor for operating the pitch bend in both directions to a maximum degree. Accordingly, the pitch bend device of the present invention is very effective to give rich expression in playing an electronic musical instrument. Particularly, the pitch bend device shown by means of the embodiment of FIG. 1 to FIG. 3 provides remarkable advantage in bringing the pitch deviation in the upper and lower directions into conformity.

Further, in addition to utilizing for the above-mentioned present invention, the pitch bend circuit arrangement can also be utilized for controlling the brilliance bend (or tone bend) to control the cut-off frequency of the tone filter.

It should be apparent to one skilled in the art that the above described embodiments are merely a few of the many specific embodiments which represent the application of the principles of the present invention. Numerous and varied other embodiments can be readily devised by those skilled in the art without departing from the spirit and scope of the present invention.

We claim:

1. In an electronic musical instrument of the type wherein a pitch voltage that is different for each of the keys is generated, a voltage-controlled oscillator is controlled by means of a pitch voltage corresponding to a depressed key, and a musical tone signal of a pitch corresponding to said depressed key is synthesized, and which further comprises a pitch bend means; the combination of a gain-varying amplifier circuit to which input terminal is applied a reference voltage, a first variable resistor which is so connected in said amplifier circuit that the gain of said amplifier circuit is changed depending upon the position of a slider for operating the pitch bend means, and a second variable resistor which is so connected in said amplifier circuit that the gain of said amplifier circuit is variably set to determine the varying width of the pitch bend, each of said pitch voltage being formed based on an output voltage taken out from the output side of said amplifier circuit responsive to the change of resistances of said first and second variable resistors.

2. In an electronic musical instrument of the type wherein a pitch voltage that is different for each of the keys is generated, a voltage-controlled oscillator is controlled by means of a pitch voltage corresponding to a depressed key, and a musical tone signal of a pitch corresponding to said depressed key is synthesized, and which further comprises a pitch bend means; the combination of a gain-varying amplifier circuit to which input terminal is applied a reference voltage, said amplifier circuit comprising an operational amplifier to which noninverting terminal is applied the reference voltage via a series resistor, a first variable resistor which is so connected in said amplifier circuit that the gain of said amplifier circuit is changed depending upon the position of a slider for operating the pitch bend means, said first variable resistor being connected between an inverting input terminal and the noninverting input terminal of the operational amplifier, the middle point of said first variable resistor being grounded, a second variable resistor which is so connected in said amplifier circuit that the gain of said amplifier circuit is variably set to determine the varying width of the pitch bend, said second variable resistor being connected between a slider of said first variable resistor and the grounded point, a feedback resistor having a resistance nearly equal to that of said series resistor is connected between an inverting input terminal and an output terminal of said operational amplifier, said output voltage being taken out from the output terminal of said operational amplifier depending upon the displacement of the slider which slides in opposite directions by nearly equal amounts with respect to the middle point of said first variable resistor, whereby a pitch which varies in nearly equal amount in opposite directions is obtained responsive to said voltage ouput.

3. In an electronic musical instrument of the type wherein a pitch voltage that is different for each of the keys is generated, a voltage-controlled oscillator is controlled by means of a pitch voltage corresponding to a depressed key, and a musical tone signal of a pitch corresponding to said depressed key is synthesized, and which further comprises a pitch bend means; the combination of a gain-varying amplifier circuit to which input terminal is applied a reference voltage, a first variable resistor which is so connected in said amplifier circuit that the gain of said amplifier circuit is changed depending upon the position of a slider for operating the pitch bend means, and a second variable resistor which is so connected in said amplifier circuit that the gain of said amplifier circuit is variably set to determine the varying width of the pitch bend, each of said pitch voltage being formed based on an output voltage taken out from the output side of said amplifier circuit responsive to the change of resistances of said first and second variable resistors; said amplifier circuit further comprising an operational amplifier to which noninverting input terminal is applied said reference voltage, a feedback resistor is connected between an inverting input terminal and an output terminal of said operational amplifier, a series circuit consisting of said first variable resistor and an output resistor is connected between said inverting input terminal and said output terminal of said operational amplifier, the resistance of said output resistor is set to be of a value nearly equal to the resistance of said feedback resistor, a middle point of said first resistor is grounded, said second variable resistor is connected between the slider of said first variable resistor and the grounded point, said output voltage is taken out from a connection point of said output resistor and said first variable resistor depending upon the displacement of the slider which slides in opposite directions by nearly equal amounts with respect to the middle point of said first variable resistor, whereby a pitch which varies in nearly equal amounts in opposite directions is obtained responsive to the output voltage.

4. In an electronic musical instrument of the type wherein a pitch voltage that is different for each of the keys is generated, a voltage-controlled oscillator is controlled by means of a pitch voltage corresponding to a depressed key, and a musical tone signal of a pitch corresponding to said depressed key is synthesized, and which further comprises a pitch bend means; the combination of an adder circuit to which one adder input terminal is applied a reference voltage, a first variable resistor having a slider for operating the pitch bend means to supply a pitch bend voltage to the other adder input terminal of said adder circuit depending upon the displacement of said slider, and a second variable resistor thereby to determine the varying width of said pitch bend voltage, each of said pitch voltages being formed based on an output voltage taken out from the output side of said adder circuit responsive to the change of resistance of said first and second variable resistors.

* * * * *